US007044785B2

(12) United States Patent
Harwath et al.

(10) Patent No.: US 7,044,785 B2
(45) Date of Patent: May 16, 2006

(54) CONNECTOR AND COAXIAL CABLE WITH OUTER CONDUCTOR CYLINDRICAL SECTION AXIAL COMPRESSION CONNECTION

(75) Inventors: Frank Harwath, Naperville, IL (US); Hugh Nudd, Orland Park, IL (US)

(73) Assignee: Andrew Corporation, Orland Park, IL (US)

( * ) Notice: Subject to any disclaimer, the term of this patent is extended or adjusted under 35 U.S.C. 154(b) by 120 days.

(21) Appl. No.: 10/707,853

(22) Filed: Jan. 16, 2004

(65) Prior Publication Data

US 2005/0159043 A1 Jul. 21, 2005

(51) Int. Cl.
*H01R 17/04* (2006.01)

(52) U.S. Cl. ..... 439/585; 439/584; 439/936; 29/874; 174/102

(58) Field of Classification Search ..... 439/585, 439/578–584, 322, 936; 72/355.4, 356; 29/874; 174/102, 103
See application file for complete search history.

(56) References Cited

U.S. PATENT DOCUMENTS

| | | | | |
|---|---|---|---|---|
| 2,870,792 A | | 1/1959 | Penrose | |
| 3,582,536 A | | 6/1971 | Miller | |
| 3,701,086 A | | 10/1972 | Somerset | |
| 3,754,094 A | | 8/1973 | Ziemek et al. | |
| 4,368,350 A | | 1/1983 | Perelman | |
| 4,376,229 A | | 3/1983 | Maul et al. | |
| 4,453,796 A | * | 6/1984 | Monroe | 439/581 |
| 4,687,272 A | | 8/1987 | Spinner et al. | |
| 4,746,305 A | * | 5/1988 | Nomura | 439/319 |
| 4,774,839 A | * | 10/1988 | Caleffi et al. | 72/355.4 |
| 4,813,887 A | | 3/1989 | Capp | |
| 5,120,260 A | * | 6/1992 | Jackson | 439/585 |
| 5,137,470 A | | 8/1992 | Doles | |
| 5,137,471 A | * | 8/1992 | Verespej et al. | 439/585 |
| 5,154,636 A | | 10/1992 | Vaccaro et al. | |
| 5,166,477 A | | 11/1992 | Perin, Jr. et al. | |
| 5,284,449 A | | 2/1994 | Vaccaro | |
| 5,295,864 A | | 3/1994 | Birch et al. | |
| 5,722,855 A | * | 3/1998 | Kanda et al. | 439/578 |
| 5,760,334 A | | 6/1998 | Ziemek | |
| 5,993,254 A | * | 11/1999 | Pitschi et al. | 439/584 |
| 6,383,019 B1 | * | 5/2002 | Wild | 439/578 |
| 6,386,915 B1 | | 5/2002 | Nelson | |
| 6,558,194 B1 | * | 5/2003 | Montena | 439/585 |
| 6,590,777 B1 | * | 7/2003 | Morino et al. | 361/736 |
| 6,716,061 B1 | * | 4/2004 | Pitschi et al. | 439/578 |
| 2003/0134538 A1 | * | 7/2003 | Bolcar | 439/610 |

FOREIGN PATENT DOCUMENTS

| | | |
|---|---|---|
| DE | 900364 C | 12/1953 |
| DE | 29800824 U1 | 3/1998 |
| GB | 650429 | 2/1951 |
| GB | 1421215 A | 10/1976 |

* cited by examiner

*Primary Examiner*—Hien Vu
(74) *Attorney, Agent, or Firm*—Babcock IP, LLC

(57) ABSTRACT

A connector and coaxial cable interconnectable via axial compression upon a cylindrical section of a solid outer conductor of the cable. The cylindrical section may be formed in the cable by drawing a cable end into an interference fit between a sleeve and an outer conductor seat formed in the connector body. Alternatively, the cylindrical section may be formed in the outer conductor during cable manufacture and the cylindrical section retained between the outer conductor seat and a crimp ring radially deformed by an angled die face during axial compression. To increase flexibility of a straight walled cable, annular corrugations may be formed in the solid outer conductor with the cylindrical sections at each corrugation peak. The cylindrical section having a length of at least 3 millimeters or 4 times the corrugation depth.

21 Claims, 4 Drawing Sheets

CONNECTOR AND COAXIAL CABLE WITH OUTER CONDUCTOR CYLINDRICAL SECTION AXIAL COMPRESSION CONNECTION

BACKGROUND OF INVENTION

1. Field of the Invention

The invention relates to connectors for coaxial cable. More particularly the invention relates to cost effective connectors and a coaxial cable adapted for interconnection using axial compression along a cylindrical section formed at a peak of annular corrugation(s) in the outer conductor of the coaxial cable.

2. Description of Related Art

Transmission line cables employing solid outer conductors have improved performance compared to cables with other types of outer conductors such as metallic braid, foil, etc. Solid outer conductor coaxial cables are available in various forms such as smooth wall, annular corrugated, and helical corrugated. Smooth wall cable has the lowest materials cost but is relatively inflexible, limiting use of smooth wall cable where other than straight cable runs are required. Helical cable is flexible and relatively easy to securely terminate via connectors that thread into the helical cable corrugations. However, the helical cable profile also provides a path for water infiltration into the cable.

Annular cable is flexible and has improved resistance to water infiltration. Annular coaxial cables are typically terminated using connectors that incorporate a mechanical clamp between the connector and the lip of the outer conductor. The mechanical clamp assemblies are relatively expensive, frequently requiring complex manufacturing operations, precision threaded surfaces and or multiple sealing gaskets.

A relatively inexpensive alternative to mechanical clamp connectors is soldered connectors. Prior soldered connectors create an interconnection that is difficult to prepare with consistent quality and even when optimally prepared results in an interconnection with limited mechanical strength. Further, heat from the soldering process may damage cable dielectric and or sheathing material.

Another inexpensive alternative is interconnection by compression. Crimping is a form of compression where the compressive force is applied in a radial direction. Crimping a solid or stranded wire places a non-compressible core at the center of the crimp. This allows the crimp die to compress the connector body around the solid core at high pressure. The connector body is permanently deformed to conform to the solid mass of the wire, resulting in a strong mechanical and electrical bond. The strength of the bond in tension approaches the ultimate tensile strength of the wire. The absence of voids or air pockets in the crimp area prevents the migration of corrosive fluids within the interface. The high residual stress, in the material of the connector body, keeps the contact resistance low and stable.

Crimping braided outer conductors is more problematic. To prevent deformation of the outer conductors in relation to the center conductor, a support sleeve of one form or another may be used. Usually, the braid is captured in a layer between a tubular outer ferrule and the connector body. This crimp is not considered highly reliable. There are typically large voids in the interface allowing for corrosive degradation of the contact surfaces. The mechanical pull strength of the joint does not approach the strength of the wire. Finally, the connection allows relative movement between all 3 components, which results in a very poor, noisy electrical connection.

Due to the corrugation patterns used in solid outer conductor cables, tubular support sleeves would require a sleeve that significantly changes the internal dimensions of the cable, causing an RF impedance discontinuity. To prevent deformation of a solid outer conductor, without using an internal sleeve, an external mating sleeve adapted to key to the corrugation pattern has been used in a crimp configuration. However, the level of crimp force applicable before the outer conductor deforms is limited, thereby limiting the strength of the resulting interconnection.

Competition within the coaxial cable and connector industry has focused attention upon reducing manufacturing, materials and installation costs. Also, strong, environmentally sealed interconnections are desirable for many applications.

Therefore, it is an object of the invention to provide a method and apparatus that overcomes deficiencies in such prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The present invention applies axial, rather than radial, mechanical compression forces to connector components to create a radial compression interconnection between a connector and the outer conductor of a coaxial cable.

Figure 1:
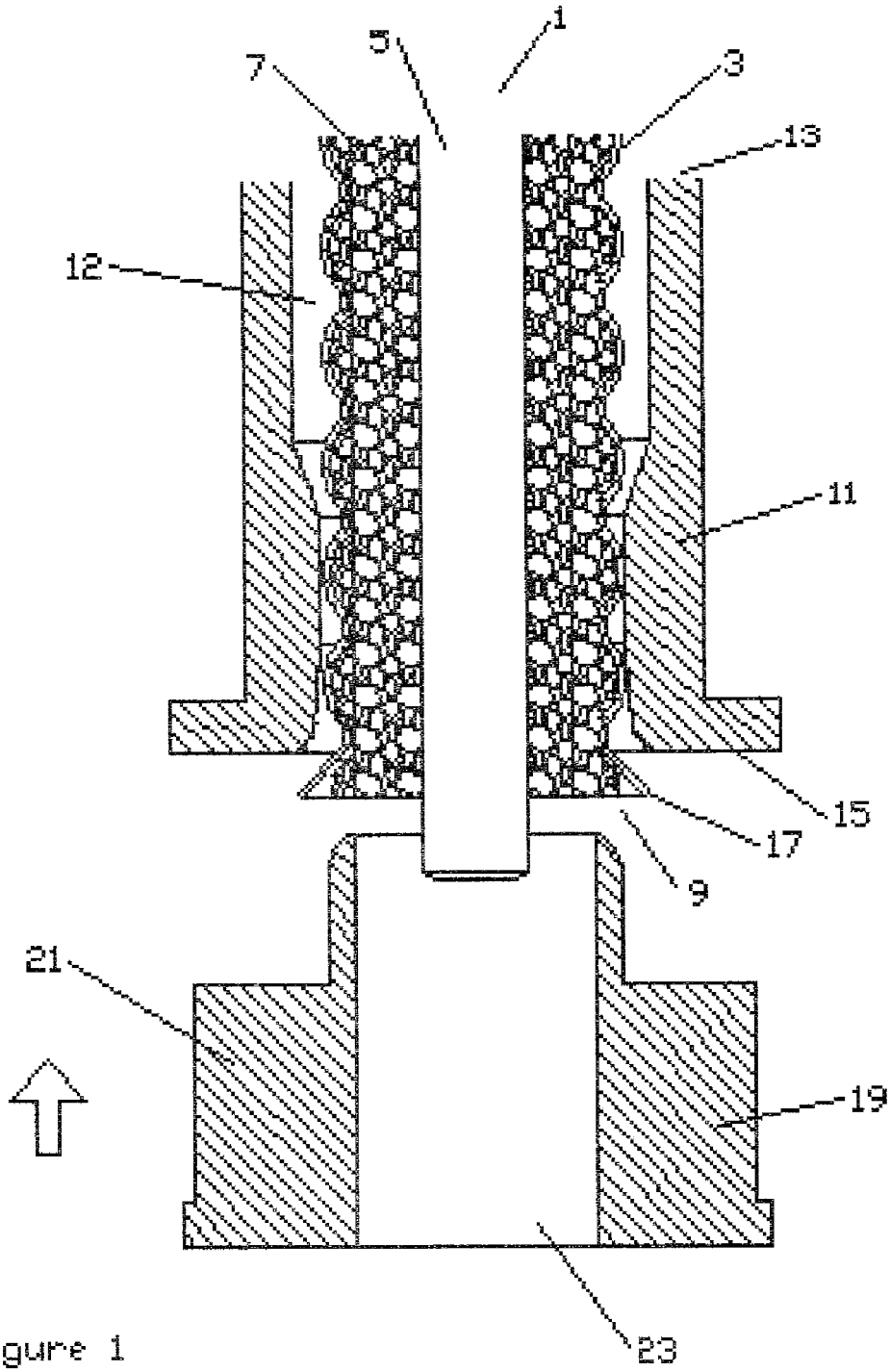
FIG. 1 is a simplified cross section side view of a first embodiment of the invention prior to axial compression.
Figure 2:
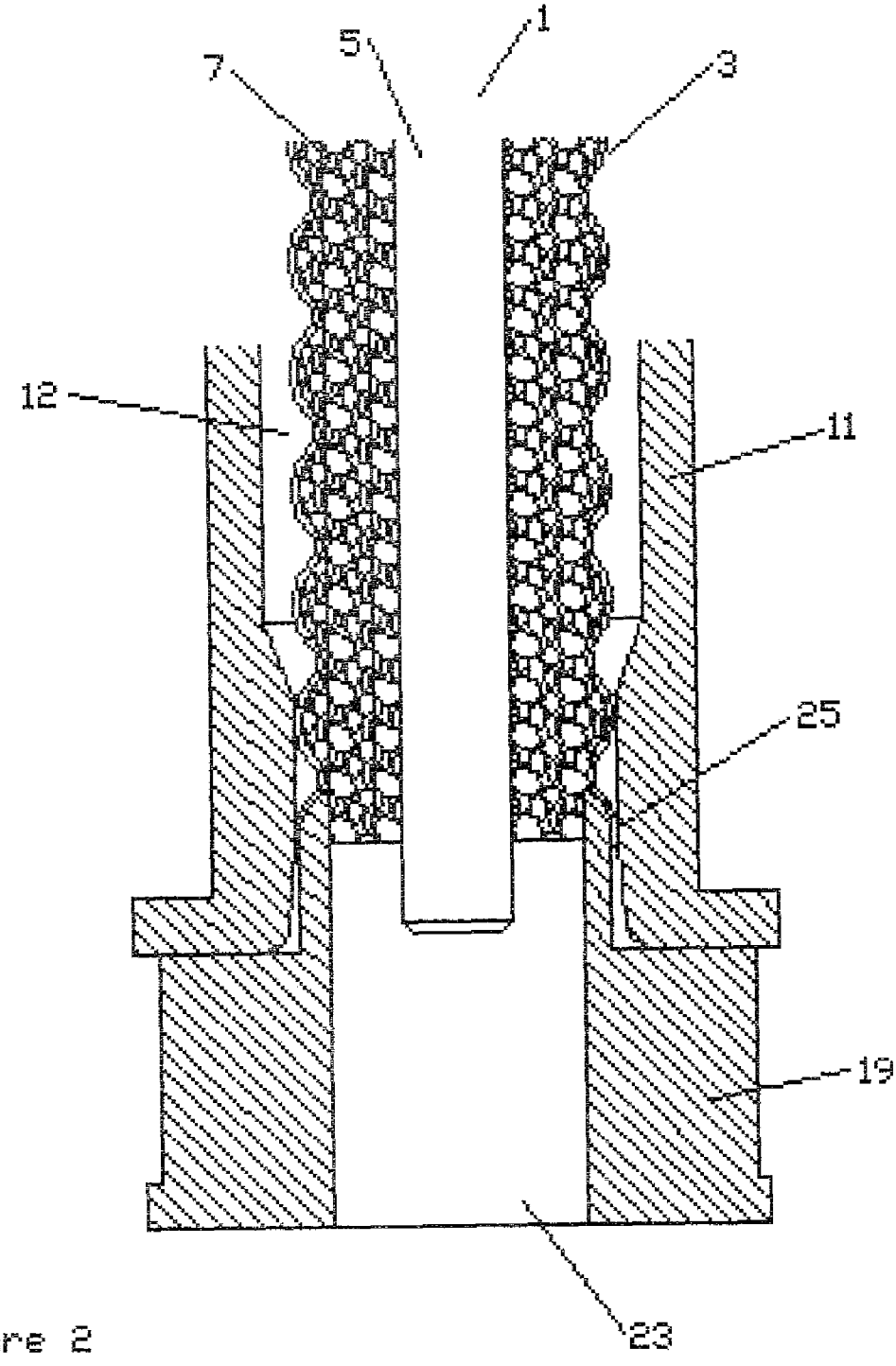
FIG. 2 is a simplified cross section side view of the first embodiment of the invention after axial compression.

A first embodiment of the invention is shown in FIGS. 1 and 2. A typical annular corrugated coaxial transmission line cable suitable for use with the invention is LDF4 manufactured by the assignee of the invention, Andrew Corporation of Orland Park, Ill. The cable 1 has an outer conductor 3 with annular corrugations and an inner conductor 5 surrounded by dielectric material 7. Prepared for axial compression, any outer protective sheath of the coaxial cable 1 is stripped back and the cable end 9 inserted through a sleeve 11. The sleeve 11 may be configured with a sleeve bore 12 having a wider sleeve cable end 13 diameter that transitions to a sleeve connector end 15 diameter which extends to the sleeve connector end 15. The sleeve cable end 13 diameter may be, for example, adapted to accept insertion of the cable 1 with the outer protective sheath in place. The sleeve connector end 15 diameter is only slightly larger than the diameter of the outer conductor 3, allowing insertion of the outer conductor 3. The outer conductor 3 is flared after insertion through the sleeve, creating a flared end 17 which prevents removal of the cable 1 through the sleeve bore 12.

A connector body 19 is configured to have a complementary outer conductor seat 21 with an outer diameter which creates an interference fit between the thickness of the outer conductor 3 and the sleeve connector end 15 diameter. Preferably, a connector body bore 23 of the connector body 19 has a diameter proximate the minimum diameter of the outer conductor 3 corrugations. Where the connector body bore 23 is substantially equal to the outer conductor 3 corrugation bottom dimension, impedance discontinuities that my otherwise be generated by the presence of the connector body 19 may be reduced. Other dimensions and features of the connector body (not shown) may be adapted by one skilled in the art to a desired connector end configuration, for example BNC, Type-N, DIN or other standardized or proprietary connector.

To complete a cable 1 and connector body 19 interconnection, the connector body 19 is axially compressed against the flared end 17 of the outer conductor 3 and the sleeve 11. As the outer conductor seat 21 presses against the flared end 17 and the flared end 17 against the sleeve connector end 15, the flared end 17 is drawn into a cylindrical section 25 at the diameter of the outer conductor corrugation peaks that forms an interference fit between the connector body 19, outer conductor 3 and sleeve 11 as shown in FIG. 2. The interference fit provides a secure, 360 degree void free contact between the outer conductor 3 and the connector body 19 with excellent electrical properties.

For smaller dimensions of cable and corresponding connector bodies, a hand tool may be used to generate the required axial compression force. A hydraulic press or the like may be used for larger diameter cables having thicker outer conductors.

In a second embodiment of the invention, axial compression is similarly applied but flaring and drawing of the outer conductor 3 into a cylindrical section 25 is avoided by forming the coaxial cable 3 with extended cylindrical section(s) 25 at each corrugation peak.

Figure 3:
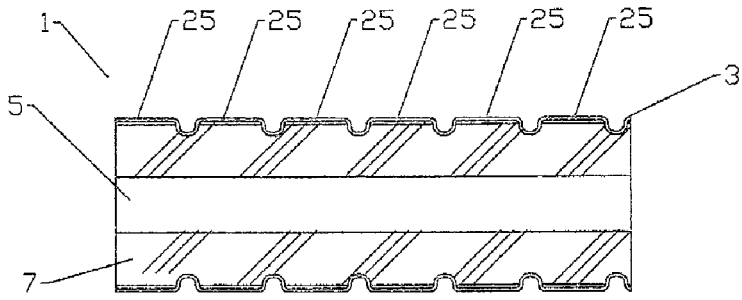
FIG. 3 is a cross section side view of an annular corrugated coaxial cable according to a second embodiment of the invention.

As shown by the cable 1 used with the first embodiment (FIGS. 1 and 2), the sinusoidal form of annular corrugations common in prior coaxial cables have a roughly equal dimension at the peak of the corrugations compared to the bottom corrugation dimension. As shown in FIG. 3, the cylindrical section(s) 25 of the novel cable 1 according to the invention have a length of at least four times that of the corresponding corrugation bottom, depending on the overall cable dimensions. Preferably, the cylindrical section is formed with a ten to one peak corrugation width to bottom corrugation width or at least a three millimeter corrugation peak cylindrical section 25.

As the length of each cylindrical section 25 is extended, the cable 1 begins to approximate the flexibility characteristics of a straight walled cable. However, at the preferred dimensions, the cable 1 according to the invention retains flexibility comparable to a conventional annular sinusoidally corrugated cable with similar dielectric material 7. The reduction in the number of total corrugations resulting from the extended peak cylindrical section reduces the overall materials requirement for the outer conductor of the cable, reducing the materials cost of the cable, overall.

Figure 4:
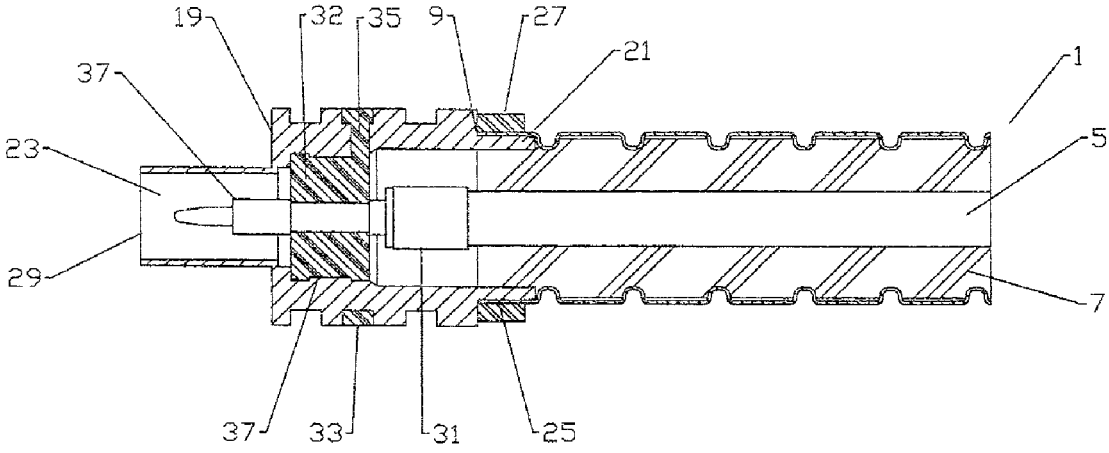
FIG. 4 is a cross section side view of the annular corrugated coaxial cable of FIG. 3, fitted with a connector, prior to axial compression.

With the cable end 9 prepared by trimming just behind a corrugation to expose a cylindrical section 25 for interconnection, a sleeve in the form of a crimp ring 27 is placed over the outer conductor 3 and an outer conductor seat 21 of a connector body 19 is fitted into the cable end 9 against the inner surface of the outer conductor 3, as shown in FIG. 4.

Figure 5:
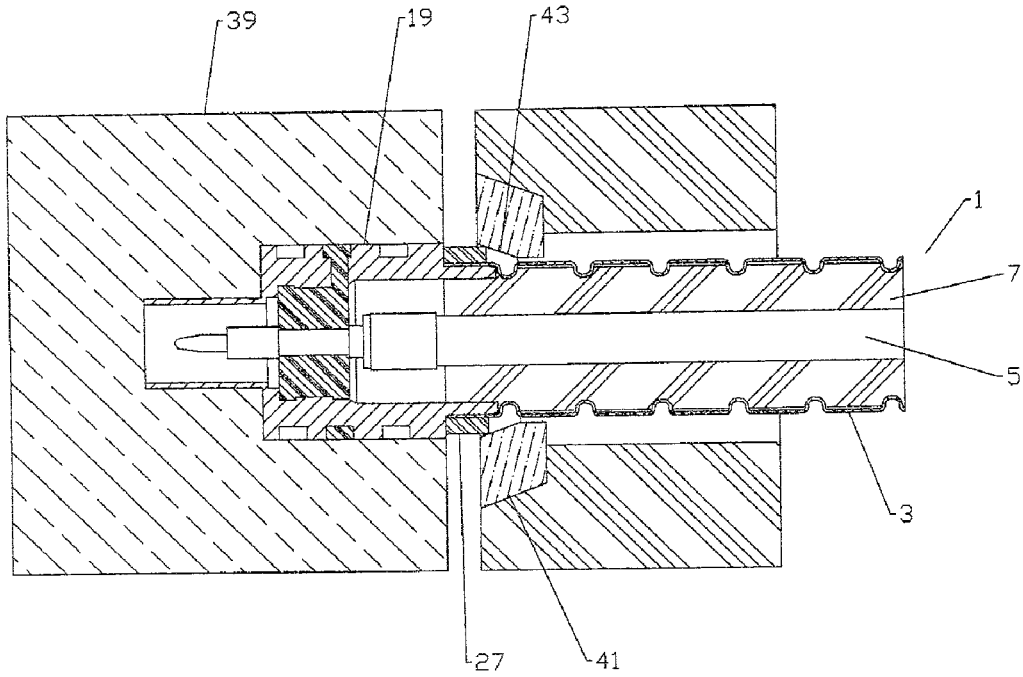
FIG. 5 is a cross section side view of the annular corrugated coaxial cable of FIG. 3, fitted with a connector, prior to axial compression, showing axial compression tooling.
Figure 6:
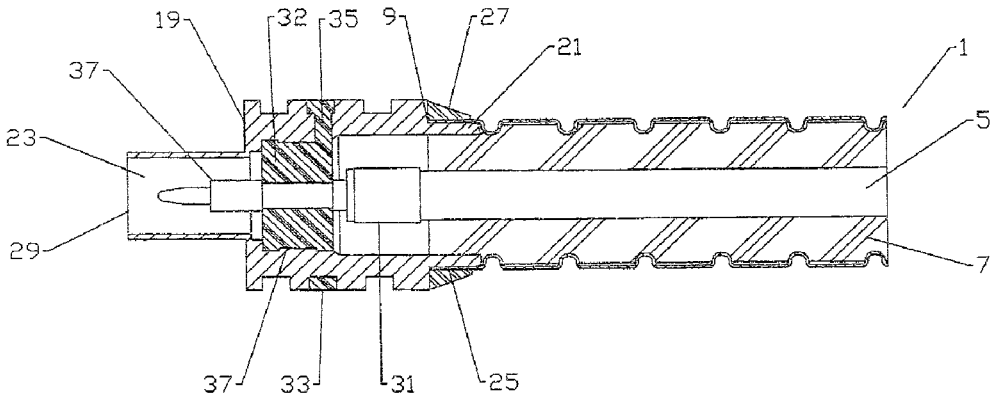
FIG. 6 is a cross section side view of the annular corrugated coaxial cable of FIG. 3, fitted with a connector, after axial compression.

The connector body connector end 29 shown in FIGS. 4–6 is adapted to a Type N connector configuration. Other connector end configurations, described hereinabove may also be used as desired. The cable 1 is trimmed so that an end of the center conductor 5 of the cable 1 extends beyond the outer conductor 3 and the dielectric material 5. The center conductor 5 may be electrically connected, to a center contact 31 of the connector, via spring fingers incorporated into the center contact 31. The center contact 31 may be supported, coaxial with the connector body 19 by, for example, an insulator 32 formed by an insertmolded polymer that is injected via a ring groove 33 and one or more opening(s) 35 which connect the ring groove 33 to the connector body bore 23. The molded polymer may be secured to the outer conductor and center contact by, for example, ridge(s) 37 on the inner surfaces of the connector body 19 and outer surfaces of the center contact 31.

The crimp ring 27 is a cylindrical ring designed to slip over the outer conductor 3 of the cable 1 prior to inserting the connector body outer conductor seat 21 into the end of the cable 1. To minimize thermal expansion differentials that may degrade the interconnection over time, the crimp ring 27 is preferably formed from a material with good ductility and a similar thermal expansion coefficient to that of the material used for the outer conductor of the cable. Where the outer conductor 3 material is copper, the crimp ring material may be, for example, annealed copper.

As shown in FIG. 5, the connector body 19 may be held in a nest 39. The crimp ring 27 is contacted by the angled surfaces of two or more segmented dies 41. To allow removal after the compression force application, the segmented die(s) 41 may be adapted to nest within another carrier die 45. When the nest 39 and segmented die(s) 41 are placed over the connector and crimp ring, they are moved axially relative to each other whereby an angled die surface 43 deforms the crimp ring 27 inward in a radial fashion. This causes the crimp ring 27 to experience stresses beyond an elastic limit. It becomes permanently deformed as shown in FIG. 6, securing the connector body 16 to the outer conductor 3.

The axial movement of the dies during application of the compressive force allows a contiguous 360 degrees of radial contact upon the crimp ring 27, simultaneously. Therefore, the deformation of the crimp ring 27 is uniform. This creates a void free interconnection with high strength; very low and stable contact resistance, low inter-modulation distortion and a high level of interconnection reliability.

For systems or parts of systems where high cable flexibility is not a requirement, the connector according to the second embodiment may be used interchangeably with straight walled coaxial cable.

The invention provides a cost effective connector and cable 1 interconnection with a minimum number of separate components, materials cost and required manufacturing operations. Further, the connector and cable 1 interconnection according to the invention has improved electrical and mechanical properties. The invention has been adapted for use with both standard annular corrugation cables and a novel cable optimized for the connector. Installation of the connector onto the cable in either embodiment may be achieved with a minimum of time and required assembly operations.

Table of Parts

| | |
|---|---|
| 1 | cable |
| 3 | outer conductor |
| 5 | inner conductor |

-continued

| Table of Parts | |
|---|---|
| 7 | dielectric material |
| 9 | cable end |
| 11 | sleeve |
| 12 | sleeve bore |
| 13 | sleeve cable end |
| 15 | sleeve connector end |
| 17 | flared end |
| 19 | connector body |
| 21 | outer conductor seat |
| 23 | connector body bore |
| 25 | cylindrical section |
| 27 | crimp ring |
| 29 | connector body connector end |
| 31 | center contact |
| 33 | ring groove |
| 35 | opening(s) |
| 37 | ridge(s) |
| 39 | nest |
| 41 | segmented die(s) |
| 43 | angled die surface |
| 45 | carrier die |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. An electrical connector for a coaxial cable with a solid outer conductor, comprising:

a connector body with a cylindrical outer conductor seat; and a deformable crimp ring;

the outer conductor seat and the crimp ring adapted to receive a cylindrical section of the solid outer conductor between the outer conductor seat and the crimp ring and to retain the cylindrical section between the outer conductor seat and the crimp ring upon application of a compression force applied along a longitudinal axis of the coaxial cable between the connector body and the crimp ring.

2. The connector of claim 1, further including a connector body bore; the connector body bore coaxial with the outer conductor seat.

3. The connector of claim 2, further including a center contact positioned coaxially within the connector body bore.

4. The connector of claim 3, wherein the center contact retained by an insulator.

5. The connector of claim 4, wherein the insulator is formed by injection molding injected through at least one opening formed in the connector body.

6. The connector of claim 3, wherein the connector body and center contact are adapted to one of a BNC, Type N and DIN configuration.

7. A connector in combination with a coaxial cable having a solid outer conductor, comprising:

a connector body with an outer conductor seat; and a deformable crimp ring;

an end portion of the outer conductor of the coaxial cable retained between the outer conductor seat and the deformable crimp ring upon application of a compression force applied along a longitudinal axis of the coaxial cable between the connector body and the crimp ring.

8. The combination of claim 7, wherein the solid outer conductor has annular corrugations; the annular corrugations having a cylindrical section at a peak of each corrugation.

9. The combination of claim 7, wherein the cylindrical section has a length, along a longitudinal axis of the coaxial cable, at least four times a depth of the corrugations.

10. The combination of claim 7, wherein the cylindrical section has a length, along a longitudinal axis of the coaxial cable, at least ten times a depth of the corrugations.

11. The combination of claim 7, wherein the cylindrical section has a length, along a longitudinal axis of the coaxial cable, of at least 3 millimeters.

12. The combination of claim 7, wherein the crimp ring and the solid outer conductor are formed from material(s) having a substantially equal thermal expansion coefficient.

13. The combination of claim 7, further including a bore in the connector body coaxial with the outer conductor seat; and a center contact retained in the bore by an insulator.

14. The combination of claim 13, wherein the insulator is an injection molded plastic; the plastic injected via at least one opening through the connector body to the bore.

15. A method for attaching a connector body to a coaxial cable having a solid outer conductor, comprising the steps of:

placing a crimp ring over an end the solid outer conductor;

inserting a cylindrical section of the solid outer conductor over a conductor seat of the connector body;

applying axial compression between the connector body and the crimp ring to deform the crimp ring over the cylindrical section of the solid outer conductor and the conductor seat, thereby retaining the cylindrical section between the crimp ring and the conductor seat.

16. The method of claim 15, wherein the axial compression between the connector body and the crimp ring is applied upon a 360 degree periphery of the crimp ring.

17. The method of claim 15, wherein the axial compression applied to the crimp ring is via a die surface angled towards the coaxial cable.

18. The method of claim 15, wherein to apply the axial compression, the connector body is positioned in a nest; and a segmented die applied to the crimp ring is held by a host die.

19. A coaxial cable, comprising:

a cylindrical solid outer conductor surrounding an inner conductor isolated from the solid outer conductor by a dielectric;

the solid outer conductor having annular corrugations with a cylindrical section at each corrugation peak;

the cylindrical section having a length, along a longitudinal axis of the coaxial cable, at least ten times a depth of the corrugations.

20. The cable of claim 19, wherein the cylindrical section has a length, along a longitudinal axis of the coaxial cable, of at least 3 millimeters.

21. The cable of claim 19, wherein the solid outer conductor is one of copper and copper alloy.

* * * * *